United States Patent [19]

Buschor

[11] Patent Number: 4,788,933

[45] Date of Patent: Dec. 6, 1988

[54] ELECTROSTATIC SPRAYING DEVICE FOR SPRAYING ARTICLES WITH POWDERED MATERIAL

[75] Inventor: Karl Buschor, St. Gallen, Switzerland

[73] Assignee: Ransburg-Gema AG, Switzerland

[21] Appl. No.: 23,478

[22] Filed: Mar. 9, 1987

[30] Foreign Application Priority Data

Mar. 13, 1986 [DE] Fed. Rep. of Germany ..... 3608426
Mar. 13, 1986 [DE] Fed. Rep. of Germany ..... 3608415

[51] Int. Cl.[4] ..... B05B 7/22

[52] U.S. Cl. ..... 118/629; 239/692; 239/698

[58] Field of Search ..... 239/692, 698, 706, 690, 239/696, 419, 419.3, 426; 118/629

[56] References Cited

U.S. PATENT DOCUMENTS

| | | | |
|---|---|---|---|
| 3,326,182 | 6/1967 | Inoue | 118/629 |
| 4,289,278 | 9/1981 | Itoh | 239/706 |
| 4,341,347 | 7/1982 | DeVittorio | 239/706 |

FOREIGN PATENT DOCUMENTS

| | | | |
|---|---|---|---|
| 203694 | 12/1986 | European Pat. Off. | 239/698 |
| 2105616 | 3/1983 | United Kingdom | 239/706 |

*Primary Examiner*—Shrive Beck
*Attorney, Agent, or Firm*—Ostrolenk, Faber, Gerb & Soffen

[57] ABSTRACT

A spraying device for spraying powdered material on an article includes an axially extending powder channel formed in the body of the spraying device which has an upstream region and a downstream end. The material flows out through a spraying opening located at the downstream end. A support extends from the spraying opening, upstream into the powder channel. The support defines a gas channel therein. A plurality of gas outlet orifices, located near the spraying opening, connect the gas channel to the powder channel. The orifices are inclined obliquely in the downstream direction. Electrical electrodes, connected to a high voltage, extend into the orifices and reach to or just beyond the orifices, into the powder channel. The axial distance from the tip of the electrodes to the spraying opening should be about equal to the diameter of the powder channel or according to an alternate embodiment about one half the diameter. The gas flowing past the electrodes picks up and carries electrical charges from the electrodes into the powdered material and further prevents settling of a powdered material on the electrodes.

22 Claims, 2 Drawing Sheets

ELECTROSTATIC SPRAYING DEVICE FOR SPRAYING ARTICLES WITH POWDERED MATERIAL

BACKGROUND OF THE INVENTION

The present invention relates generally to electrostatic spraying devices for spraying powdered material on an article.

The invention concerns two types of electrostatic spraying devices. The first type has an axially extending body with a powder channel extending axially through the spraying device and a spraying opening at a downstream end of the spraying device. A rod-like support which lies on the axis of the device extends from the spraying opening for some distance into the powder channel.

Extending along the axis, beyond the spraying opening and coupled to the support is a powder deflection device. The deflection device receives a supply of gas from a gas channel which is provided within the spraying device body. The gas is guided by the powder deflection device to flow in a generally radial direction so as to form a gas wall which extends transversely to the axis of the spraying device. The effect of the gas wall is to further pulverize the powdered material and to mix and disperse it into a cloud of the material. At least one electrode, which is connected to a high voltage, is provided in the spraying device for electrostatically charging the powdered material.

The second type of spraying device is similar to the first type, except that the powder deflection device comprises a baffle against which the powdered material issuing from the spraying opening impinges to transform the axially flowing stream of particles into a cloud of powder.

Various electrostatic spraying devices are known. Japanese patent application No. 54-80 06, published under No. 55-99 361(A), as well as its Abstract which appears in "Patent Abstract of Japan," Oct. 29, 1980, Vol. 4, No. 155 describes a powder deflection device formed of a thickened, tear-shaped extension of an axial support which extends in the spraying device. A plurality of openings in the powder deflection device are arranged, star-like, around the thickened tear-shaped section. The openings are inclined forwardly in the direction of flow of the stream of powder and produce a gas wall which extends generally transversely to the stream of powder. The stream of powder is thereby converted into a cloud of powder.

German Application DE-OS No. 23 12 363 shows an electrostatic spraying device having a centrally located and axially extending support from which a pneumatically operable powder deflection device extends. An annular electrode located downstream of the spraying opening forms a short channel section which is part of the outer face of the powder channel and which serves to electrostatically charge the powdered material.

U.S. Pat. No. 4,289,278 discusses the feasibility of providing an electrode which extends axially within the powder channel and downstream of the spraying opening, generally at the axis or at the radial center of the device. Moving gas around the electrode to assure that particles of powder are not deposited on the electrode is also shown. Such an electrode can be located directly within the stream of powder or in a gas channel which leads into the powder channel.

EPO Publication No. 0 123 964 Al relating to European patent application No. 84 103 84.7 illustrates a spraying device with a pneumatically operable powder deflection device which is located downstream, outside, and beyond the spraying opening of the spraying device. The powder deflection device is supported by a support of the spraying device which extends axially through the spraying opening into the powder channel. The powder deflection device produces a gas wall which flows out of a substantially radial annular slot which is slightly inclined forwardly in the downstream direction of the powder. The annular slot is defined by a front face of the support and a disk located forwardly of the front face. The disk is a semiconductor electrode which is connected to a high voltage.

German Application DE-OS No. 19 32 387 describes an electrostatic spraying device in which an electrode is arranged centrally in an axially extending channel and directly upstream of the spraying opening. Two annular slits are disposed axially behind one another in the outer face of the channel. The annular slits coaxially surround the electrode. Air is supplied through the first annular slot nozzle while a colored liquid which is supplied from the second annular slit nozzle flows against the electrode.

German Patent No. 25 39 27, which substantially corresponds to US. Pat. No. 3,940,061, illustrates an electrode which is moved about by a flow of air and which is located at the center of the spraying opening of an electrostatic spraying device.

SUMMARY OF THE INVENTION

It is an object of the present invention to provide an electrostatic spraying device which produces a better quality and more efficient spray.

It is another object of the invention to provide a spraying device which reduces powdered material loss and therefore maximizes the quantity of powdered material which reaches the article to be coated.

It is still a further object of the invention to provide a spraying device which enables the application of a thicker layer of powder in a single spraying operation.

The foregoing and other objects of the invention are realized in a first embodiment of the invention in which the spraying device includes an axially extending spraying device body having an upstream region and a downstream end. An axially extending powder channel with a spraying opening at the downstream end of the spraying device body is formed within the spraying device body. The powder channel guides the powder material downstream to the spraying opening. Further, the material is electrostatically charged in the powder channel.

A rod-shaped member extends generally centrally and over a portion of the powder channel. The rod-shaped member extends from the spraying opening a predetermined distance upstream into the powder channel. Therefore, the powder channel has an annular transverse cross-section in the vicinity of the rod-shaped member. A gas channel is defined and extends through the rod-shaped member for supplying gas to the powder channel. At least one gas outlet orifice, located near and upstream of the spraying opening, connects the gas channel to the powder channel. Preferably, there are a plurality of such gas outlet orifices which are arranged circumferentially around the gas channel. The orifices extend generally radially but are somewhat inclined downstream toward the spraying opening.

An electric line, connected to a high voltage source, is disposed in the gas channel. A plurality of electrodes are connected to the electric line. Each electrode, in turn, extends into a respective one of the orifices. Preferably each electrode has an electrode tip which extends to the end of the orifice and generally flush with the outer surface of the rod which faces into the powder channel.

The gas flowing in the gas channel flows through the orifices into the powder channel. In the process, the gas carries electrical charges from the electrodes for charging the powdered material. At the same time, the gas flows around the electrodes and prevents powdered material from settling on them.

Superior results are obtained when the axial distance from the opening of the orifices into the powder channel to the spraying opening of the spraying device is approximately equal to the outer diameter of the annularly shaped powder channel. That distance should be between 12 to 16 mm and more preferably about 14 mm.

The first embodiment further includes a powder deflection device which comprises an extension of the rod-shaped member that includes a gas channel defined therein which is coupled to the gas channel defined within the powder channel. An annular slot in the powder deflection device directs the gas to flow generally radially and transversely to the axially directed stream of powdered material. The gas flow serves to further pulverize the powdered material, to disperse the particles in the material, and to assure that the powdered material is more uniformly charged.

The second embodiment of the invention is substantially similar to the first. Here the distance from the orifice to the spraying opening is approximately one half the magnitude of the outer diameter of the powder channel. Further, the powder deflection device comprises a baffle on which the stream of powdered material impinges. The baffle may include a front surface, which faces in the downstream direction of the device, or in other words, away from the spraying opening, and an arrangement whereby gas from the gas channel is directed to flow against the front surface. This produces a forwardly inclined gas wall and improves powder deflection. In a further modification, the powder deflection device includes an axial opening through which gas can flow axially downstream and out of the powder deflection device.

Other features and advantages of the present invention will become apparent from the following description of the invention which refers to the accompanying drawings.

DETAILED DESCRIPTION OF THE PREFERRED EMBODIMENTS

Figure 1:
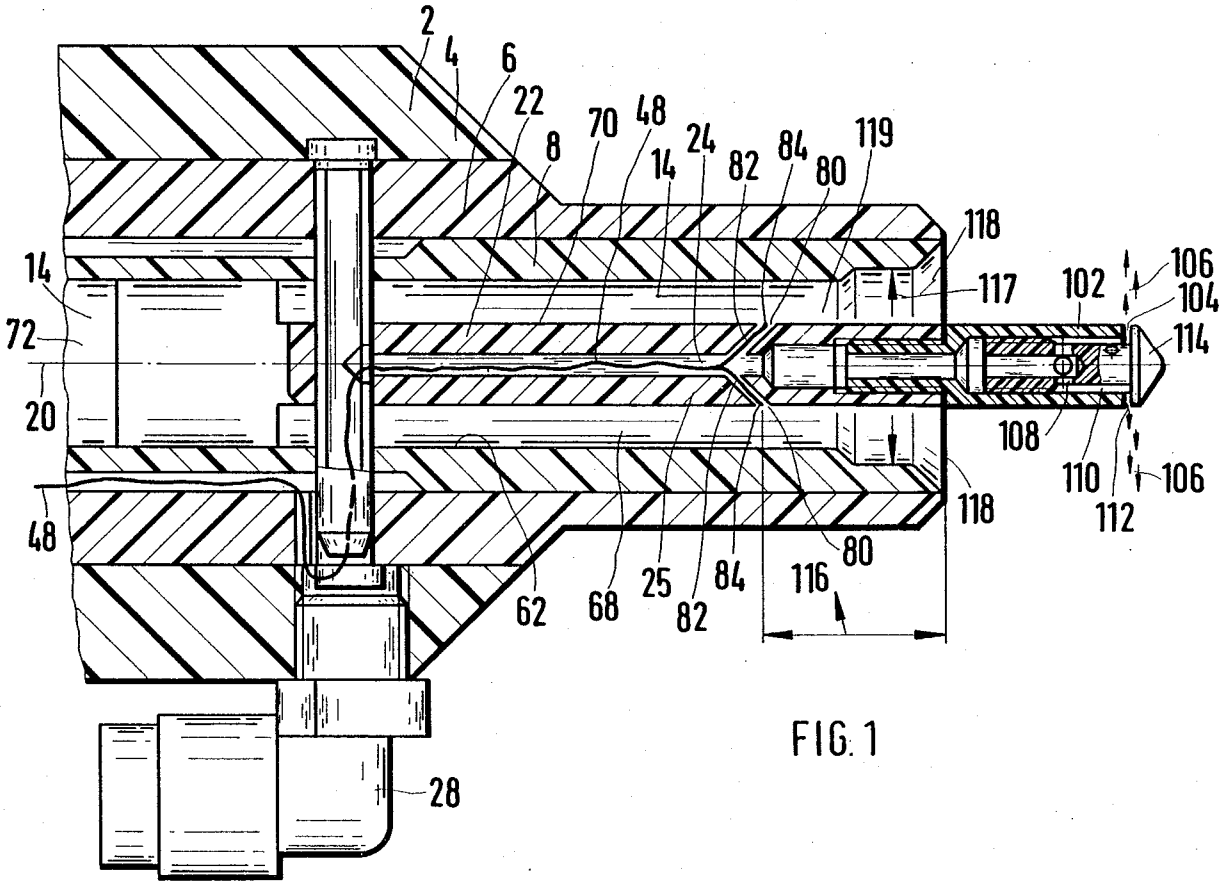
FIG. 1 is a longitudinal cross-section through an end section of an electrostatic spraying device according to a first embodiment of the present invention.

Referring to FIG. 1, an electrostatic spraying device according to the invention includes a tubular base 2 formed of coaxial parts 4, 6 and 8 which sequentially surround one another. A powder channel 14 extends axially through the innermost part 8. The downstream end of channel 14 has a spray opening 18. Extending along the axis 20 and within powder channel 14 is a device 22 including a rod-shaped support 25 at the center of channel 14. Support 25 shapes that portion of powder channel 14 adjacent support 25 into annular channel 68. The annular powder channel section 68 is defined on the outside by a cylindrical inner wall surface 62 of part 6 and on the inside by the cylindrical wall surface 70 of support 25. Upstream of device 22, powder channel 14 has a full cylindrical cross-section 72.

A gas channel 24 passes axially through support 25 and extends along axis 20 of powder channel 14. Gas channel 24 is in fluid communication with a gas connection pipe 28. An electric line 48, connected to a high voltage source of electricity located either in base member 2 or external to the spraying device, extends along gas channel 24.

Gas channel 24 leads into powder channel section 68 via two or more gas outlet openings or orifices 80 formed in support 25 and distributed uniformly around its circumference. Openings 80 extend generally radially outwardly and somewhat obliquely downstream toward the spraying opening 18.

A respective electrode 82 which is connected to electric line 48 is disposed in each of the gas outlet openings 80. The electrode ends or tips 84 should preferably extend radially to the outer surface 70 of the support. Electrode ends 84 may, however, terminate, about 0.1 to 3.0 mm short of the outer surface 70 or may extend slightly beyond that surface. The latter arrangement requires a stronger flow of gas in order to prevent powdered material from settling on electrode ends 84. The diameter of gas outlet openings 80 is only slightly larger than the diameter of electrodes 82.

Although a single gas outlet opening 80 may provide adequate results, two or more such openings each having at least one electrode 82 therein, are preferred to obtain better electrostatic effect. Since electrodes 82 are located in gas outlet openings 80 and gas flowing in gas channel 24 moves around the electrodes, powder does not deposit on the electrodes, even where little gas or gas of relatively low pressure is fed through gas channel 24.

Support 25 extends beyond spray opening 18. At its outer extension, support 25 forms a powder deflection device 102 for causing the powder emerging from spray opening 18 to be deflected substantially radially. Powder deflection device 102 contains an annular gas opening 104 which opens radially outwardly transversely to the longitudinal direction of powder channel 14. The gas which emerges from opening 104 produces a gas wall 106 which blows through the axially flowing stream of powder which exits from opening 18.

Opening 104 may instead be formed of a plurality of substantially radial openings for the gas for producing gas wall 106. The gas wall, therefore, has the form of a circular disk transverse to the axial direction of powder channel 14.

Gas, preferably air, is supplied to gas opening 104 from channel 24, through radial holes 108 which communicate into a short adjoining annular channel 110 formed in support 25. Transverse gas opening 104 is formed by an annular slot located between the end side 112 of support 25 and a cap 114 which is inserted like a plug at the end of the support. Uniformly over its length and extending to cap 114, support 25 has a constant outer diameter equal to that of cap 114. Support 25 and cap 114 could, however, have unequal diameters.

The distance 116 from electrode ends 84 or from the center of gas outlet openings 80 at outer surface 70 of support 25 to the downstream end 118 of spray opening 18 is about equal to the outer diameter 117 of powder channel 14, measured directly upstream of spray opening 18. Without regard to the diameter 117 of powder channel 14, the distance 116 should be in the range of about 12 to 16 mm and preferably 14 mm.

The powder channel section 119 of the powder channel 14, lying between gas outlet openings 80 and spray opening 18, is annular in cross-section. This produces a damming or a suction region at section 119. Depending upon the speed of the gas of the gas wall 106, when the gas speed in gas wall 106 is relatively low, the flow of powder in section 119 is resisted or slowed, i.e. dammed. When the pneumatically conveyed powder impinges on gas wall 106 it is thus compressed in powder channel section 119. The gas flow is sufficiently slow that it does not create any suction or siphoning action to affect the stream of powder emerging from spray opening 18. When the gas velocity in gas wall 106 is high, the powder in powder channel section 119, is sucked out by the injector-like suction action produced in powder channel section 119. To produce such suction, the gas velocity of gas wall 106 is greater than the powder flow velocity in powder channel section 119. In both cases, gas wall 106 acts as a baffle member, which drives the powder stream radially apart and converts it into a cloud of powder.

The gas flowing in gas channel 24 collects electrical charge from electrodes 82 and deposits the charge within powder channel section 119, thus transferring the charge to the powdered material. The radially more inward powder particles are displaced with respect to the more radially more outward powder particles by the stream of gas in gas wall 106. This produces eddy currents in the powder and the more strongly charged powder particles give off electric charge to the more weakly charged powder particles, and thus causes further electrical charge to be extracted from electrodes 82.

The parts of the spraying device of the present invention which are contacted by the powder, are preferably constructed of plastic.

The present invention provides several advantages. These include obtaining a coating of higher quality; reduction in energy consumption in the device; smaller losses of powder as the powder travels from the spraying device to the article to be coated; a powder coating of a constant quality; uninterrupted operation of the spraying device since the electrodes are permanently cleaned through the action of the stream of gas and due to their location within the gas outlet; and the ability to produce a powder layer of greater thickness in a single spraying of an article to be coated.

The novel structure of the spraying device of the present invention produces several effects which are summarized below.

A stronger electrostatic charging of the powder is obtained in that the powder is charged electrostatically by electrodes 82 toward the radial center of the powder channel 14. The particles of powder are later displaced relative to each other by the action of the gas in gas wall 106. Charge is therefore transferred between the differently charged powder particles, with an overall effect of causing more of the charge to be extracted from electrodes 84.

The gas flowing in gas channel 24 picks up electric charge from electrodes 82 and drives it, injector-like fashion, radially outwardly and over the entire cross section of the powder channel section 119 through the stream of powder. All the powder particles become electrostatically charged while the particles are still within powder channel section 119.

The electric field lines which extend from the electrically charged electrodes 82 to the electrically grounded article to be coated, extend along ideal paths through the gas wall 106, and stray electric fields are not produced to adversely affect the field lines.

When the gas velocity in gas wall 106 is low, the powder particles in the region directly upstream of the spray opening 18 in powder channel section 119 become compressed. This causes stronger electrostatic charging. When the gas velocity is high, the powder particles are accelerated in the region directly upstream of spray opening 18. The powder particles radially closer to electrodes 18 are then charged more strongly than the powder particles which are radially further away. The more strongly charged powder particles are driven radially outwardly by the gas wall 106 and are thus mixed with the less strongly charged powder particles. The more weakly charged powder particles receive additional charge from more strongly charged powder particles. All of the powder particles attain sufficient charge which strongly attracts them to the article to be coated, without their being bounced off the article.

Figure 3:
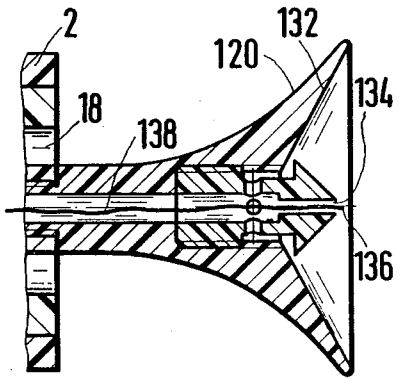
FIG. 3 is a longitudinal cross-section through a modified version of the second embodiment of FIG. 2.
Figure 2:
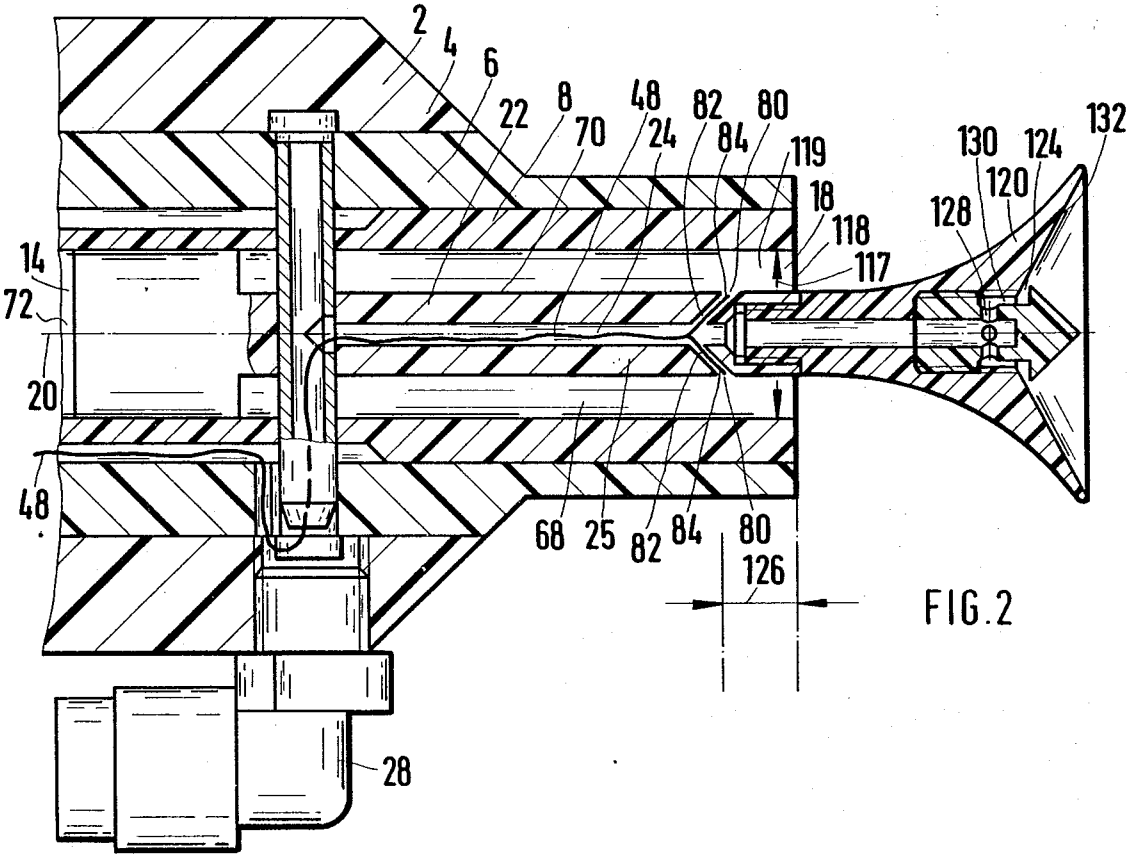
FIG. 2 is a longitudinal cross-section through the end section of a second embodiment of an electrostatic spraying device according to the present invention, which provides a mechanical baffle for comminuting the powder.

Further embodiments of spraying devices are illustrated in FIGS. 2 and 3 which show an electrostatic spraying device according to the invention to include a tubular base 2 formed of parts 4, 6 and 8 which are disposed coaxially within one another. A powder channel 14 extends axially through the innermost part 8. The downstream end of channel 14 has a spray opening 18. Extending along the axis 20 and within powder channel 14 is a device 22 including a rod-shaped support 25 at the center of the channel 14. Support 25 shapes that portion of powder channel 14 adjacent support 25 into an annular channel 68. The annular powder channel section 68 is defined on the outside by a cylindrical inner wall surface 62 of part 6 and on the inside by the cylindrical wall surface 70 of support 25. Upstream of device 22, powder channel 14 has a full cylindrical cross-section 72.

A gas channel 24 passes axially through support 25 and extends along axis 20 of powder channel 14. Gas channel 24 is in fluid communication with a gas connection pipe 28. An electric line 48, connected to a high voltage source of electricity located either in base member 2 or external to the spraying device, extends along gas channel 24.

Gas channel 24 leads into powder channel section 68 via two or more gas outlet openings or orifices 80 formed in support 25 distributed uniformly around its circumference. Openings 80 extend generally radially but somewhat obliquely downstream toward the spraying opening 18.

A respective electrode 82 which is connected to electric line 48 is disposed in each of the gas outlet openings 80. The electrode ends or tips 84 should preferably extend to the radial position of outer surface 70 of the support. Electrode ends 84 may, however, terminate, about 1.0 mm short of the outer surface 70 or may extend slightly beyond that surface. The latter arrangement requires a stronger flow of gas in order to prevent powdered material from settling on electrode ends 84. The diameter of gas outlet openings 80 is only slightly larger than the diameter of electrodes 82.

Although a single gas outlet opening 80 may provide adequate results, two or more such openings each having at least one electrode 82 therein, are preferred to obtain better electrostatic effect. Since electrodes 82 are located in gas outlet openings 80 and gas flowing in gas channel 24 moves around the electrodes, powder does not deposit on the electrodes, even where little gas or gas of relatively low pressure is fed through gas channel 24.

Support 25 extends beyond spray opening 18. There it has a powder deflection device for causing the powder emerging from the spray opening 18 to be deflected substantially radially. In FIG. 2, the extension of support 25 beyond spray opening 18 is a baffle member 120 which produces a damming effect in powder channel section 119 of powder channel 14 between the gas outlet openings 80 and the spray opening 18. The front or downstream side of baffle member 120, which faces away from spray opening 18, has a transverse or radially directed air opening 124, which is supplied with gas from gas channel 24. The gas leaves channel 24 via radial holes 128 and flows through annular channel section 130 to and over the substantially radially extending and obliquely downstream directed front end surface 132 of the baffle member 120. Powder particles will not, therefore, adhere to end surface 132. As shown in FIG. 2, transverse-air opening 124 is the annular radius of opening 124 from channel 130 to the outlet from opening 124 being made as small as is technically possible.

Two features are particularly worth noting in connection with the second embodiment. First the electrode ends 84 are located in gas outlet openings 80. Secondly, the distance 126 from electrode ends 84, i.e. from the center of the gas outlet openings 80, to the downstream end 118 of the spray opening 18 is not arbitrary. The distance 126 is preferably about equal to the radius of the outside diameter 117 of powder channel 14. The radius is measured in powder channel section 119 directly upstream of spray opening 18.

The embodiment of FIG. 3 is identical to the embodiment of FIG. 2, except for the additional axially extending gas outlet opening 134 which is formed through the axis of baffle member 120. Gas outlet opening 134 communicates with gas channel 24 and also holds a further electrode 136 which is surrounded by gas and which serve to electrostatically charge the powder. Electrode 136 is connected via an extension wire 138 to electric line 48. The tip of connecting wire 138 comprises the electrode 136.

The second embodiment and its FIG. 3 variant provide several advantages. For example, directly upstream of the spray opening in the powder channel, the baffle member forms a flow-resisting region within which the powder is compacted. Since the electrode is located in the gas outlet opening in the path of flowing gas, powder particles cannot adhere to it. Further, the electric field lines from the electrode pass along ideal paths through the powder particles to the article to be coated. Hardly any stray electrical fields are created. Consequently, for a given electrical energy, the powder particles are more effectively charged. The particles are attracted to the article to be coated and remain adhered to it.

The gas which flows around the electrodes picks up charge which it transfers into the compacted powder. The simultaneous compacting of the powder and the injection into it of electrical charge results in increased electrostatic charging of the powder particles. More of the powder reaches the article and a better quality coating is obtained. A thicker layer of powder can be applied with a single spraying session and energy savings are realized.

Although a corona discharge develops at the tip of each of the electrodes 84, which causes the electrodes to be heated, particles of powder do not adhere to the electrodes since the particles are constantly blown away from the electrode by the stream of gas flowing around the electrodes. Also the tip of the electrode extends only slightly or preferably not at all into the powder channel.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spraying device for spraying powdered material on an article, the device comprising:

a body having an upstream region and a downstream end;

an axially extending powder channel formed in the body and having a spraying opening at the downstream end of the body, the powder channel being shaped for guiding the powdered material downstream to the spraying opening;

a support extending through at least a portion of the powder channel, the portion of the powder channel having an annular transverse cross-section defined around the support;

a gas channel defined and extending in the support for conducting gas therethrough;

at least one gas outlet orifice extending between the gas channel and the powder channel for providing gas flow from the gas channel into the powder channel;

an electric line extending in the gas channel and an electrode connected to the electric line and extending into the orifice, the electrode including an electrode tip defined at the free end of the electrode, and the free end being located near the powder channel;

means for flowing gas past the electrode and into the powder channel for transferring charge from the electrode into the powder channel; and the powder channel having, at a location thereof directly upstream of the spraying opening, a predetermined outer diameter and wherein the axial distance from the electrode tip to the spraying opening is about equal to the predetermined outer diameter.

2. The spraying device according to claim 1, wherein the support has an outer surface and the orifice opens at the outer surface of the support, the electrode tip extending approximately to the outer surface of the support.

3. The spraying device according to claim 1, wherein the orifice is inclined toward the downstream end of the spraying device, radially outward of the support.

4. The spraying device according to claim 1, wherein the electrode tip extends, a predetermined distance, beyond the orifice into the powder channel.

5. The spraying device according to claim 1, wherein the support has an outer surface and the orifice opens at the outer surface of the support, the electrode tip being disposed within a region in the orifice defined between the outer surface of the support and about 3 mm upstream in the orifice.

6. The spraying device according to claim 1, further comprising powder deflection means coupled to the gas channel and disposed in front and downstream of the spraying opening, the deflection means being effective for creating a gas wall which extends generally transversely to the axial direction of the spraying device for dispersing the powdered material issuing from the spraying opening.

7. The spraying device according to claim 1, wherein the at least one orifice comprises a plurality of orifices, distributed circumferentially around the gas channel.

8. A spraying device for spraying powdered material on an article, the device comprising:

a body having an upstream region and a downstream end;

an axially extending powder channel formed in the body and having a spraying opening at the downstream end of the body, the powder channel being shaped for guiding the powdered material downstream to the spraying opening;

a support extending through at least a portion of the powder channel, the portion of the powder channel having an annular transverse cross-section defined around the support;

a gas channel defined and extending in the support for conducting gas therethrough;

at least one gas outlet orifice extending between the gas channel and the powder channel for providing gas flow from the gas channel into the powder channel;

an electric line extending in the gas channel and an electrode connected to the electric line and extending into the orifice, the electrode including an electrode tip defined at the free end of the electrode, and the free end being located near the powder channel;

means for flowing gas past the electrode and into the powder channel for transferring charge from the electrode into the powder channel; and the axial distance from the electrode tip to the spraying opening being in the range of 12 to 16 mm.

9. The spraying device according to claim 8, wherein the distance is about 14 mm.

10. A spraying device for spraying powdered material on an article, the device comprising:

a body having an upstream region and a downstream end;

an axially extending powder channel formed in the body and having a spraying opening at the downstream end of the body, the powder channel being shaped for guiding the powdered material downstream to the spraying opening;

a support extending through at least a portion of the powder channel, the portion of the powder channel having an annular transverse cross-section defined around the support;

a gas channel defined and extending in the support for conducting gas therethrough;

at least one gas outlet orifice extending between the gas channel and the powder channel for providing gas flow from the gas channel into the powder channel;

an electric line extending in the gas channel and an electrode connected to the electric line and extending into the orifice, the electrode including an electrode tip defined at the free end of the electrode, and the free end being located near the powder channel;

means for flowing gas past the electrode and into the powder channel for transferring charge from the electrode into the powder channel; and the powder channel having an outer diameter of predetermined value at a location thereof directly upstream of the spraying opening and wherein the axial distance from an opening of the orifice into the powder channel to the spraying opening is equal to about one half of the predetermined diameter.

11. The spraying device according to claim 10, wherein the support has an outer surface and the orifice opens at the outer surface of the support, the electrode tip extending approximately to the outer surface of the support.

12. The spraying device according to claim 10, wherein the orifice is inclined toward the downstream end of the spraying device, radially outward of the support.

13. The spraying device according to claim 10, wherein the electrode tip extends, a predetermined distance, beyond the orifice into the powder channel.

14. The spraying device according to claim 10, wherein the support has an outer surface and the orifice opens at the outer surface of the support, the electrode tip being disposed within a region in the orifice defined between the outer surface of the support and about 3 mm upstream in the orifice.

15. The spraying device according to claim 10, further comprising a baffle extending from the support, out of the spraying device body and downstream of the spraying opening for deflecting the powdered material issuing from the spraying opening generally radially outwardly.

16. The spraying device according to claim 15, wherein the orifice is inclined toward the downstream end of the spraying device, radially outward of the support.

17. The spraying device according to claim 15, including a gas channel extension which is defined and extends axially in the baffle and a cap at the downstream end of the gas channel extension, and further including an inclined surface in the baffle and an annular gas channel which is coupled to the gas channel extension for permitting gas from the gas channel extension to flow through the annular opening along the inclined surface of the baffle, the inclined surface being located at a front face of the baffle which faces axially downstream, away from the spraying opening.

18. The spraying device according to claim 17, further comprising an axially extending gas channel in the cap for permitting gas to flow axially through and out of the cap and a further electrode disposed in the axially extending gas channel in the cap.

19. The spraying device according to claim 10, wherein the support has an outer surface and the orifice opens at the outer surface of the support, the electrode tip extending approximately to the outer surface of the support.

20. The spraying device according to claim 10, wherein the support has an outer surface and the orifice opens at the outer surface of the support, the electrode tip being disposed in the orifice in a region thereof located between the outer surface of the support and about 1 mm upstream thereof.

21. A spraying device for spraying powdered material on an article, the device comprising:

a body having an upstream region and a downstream end;

an axially extending powder channel formed in the body and having a spraying opening at the downstream end of the body, the powder channel being shaped for guiding the powdered material downstream to the spraying opening;

a support extending through at least a portion of the powder channel, the portion of the powder channel having an annular transverse cross-section defined around the support;

a gas channel defined and extending in the support for conducting gas therethrough;

at least one gas outlet orifice extending between the gas channel and the powder channel for providing gas flow from the gas channel into the powder channel;

an electric line extending in the gas channel and an electrode connected to the electric line and extending into the orifice, the electrode including an electrode tip defined at the free end of the electrode, and the free end being located near the powder channel;

means for flowing gas past the electrode and into the powder channel for transferring charge from the electrode into the powder channel;

powder deflection means coupled to the gas channel and disposed in front and downstream of the spraying opening, the deflection means being effective for creating a gas wall which extends generally transversely to the axial direction of the spraying device for dispersing the powdered material issuing from the spraying opening; and the gas deflection means comprising:

an extension of the support located in the powder channel, the support extension protruding from the body of the spraying device past the spraying opening, a respective gas channel extending axially through the support extension, and a support extension opening in the support extension adjacent the end of the support extension, the support extension opening communicating with the gas channel in the support extension and being shaped to guide gas out of the support extension generally radially to form the gas wall.

22. The spraying device according to claim 21, in which the support extension opening extends annularly around the support.

* * * * *